US010352284B2

(12) United States Patent
Kleindl et al.

(10) Patent No.: US 10,352,284 B2
(45) Date of Patent: Jul. 16, 2019

(54) PISTON FUEL PUMP

(71) Applicant: Robert Bosch GmbH, Stuttgart (DE)

(72) Inventors: Michael Kleindl, Schwieberdingen (DE); Tamim Latif, Stuttgart (DE); Peter Ropertz, Oberriexingen (DE); Matthias Maess, Boeblingen (DE)

(73) Assignee: Robert Bosch GmbH, Stuttgart (DE)

( * ) Notice: Subject to any disclaimer, the term of this patent is extended or adjusted under 35 U.S.C. 154(b) by 52 days.

(21) Appl. No.: 15/817,698

(22) Filed: Nov. 20, 2017

(65) Prior Publication Data

US 2018/0073477 A1 Mar. 15, 2018

Related U.S. Application Data

(63) Continuation of application No. 14/410,078, filed as application No. PCT/EP2013/062578 on Jun. 18, 2013.

(30) Foreign Application Priority Data

Jun. 28, 2012 (DE) ..... 10 2012 211 107
Dec. 11, 2012 (DE) ..... 10 2012 222 826

(51) Int. Cl.
*F04B 53/10* (2006.01)
*F02M 59/46* (2006.01)
(Continued)

(52) U.S. Cl.
CPC ..... *F02M 59/462* (2013.01); *F04B 1/00* (2013.01); *F04B 53/10* (2013.01); *F04B 53/101* (2013.01);
(Continued)

(58) Field of Classification Search
CPC ..... F02M 59/462; F04B 1/00; F04B 53/16; F04B 53/1085; F04B 53/1087;
(Continued)

(56) References Cited

U.S. PATENT DOCUMENTS 1,710,635 A 4/1929 Wertz
1,938,418 A 12/1933 Evans
(Continued)

FOREIGN PATENT DOCUMENTS

CN 1673538 A 9/2005
CN 102325994 A 1/2012
(Continued)

OTHER PUBLICATIONS

International Search Report corresponding to PCT Application No. PCT/EP2013/062578, dated Sep. 6, 2013 (German and English language document) (6 pages).

*Primary Examiner* — Charles G Freay
(74) *Attorney, Agent, or Firm* — Maginot, Moore & Beck LLP

(57) ABSTRACT

A piston-type fuel pump for an internal combustion engine includes a pump housing, a piston, an annular counterplate, and a non-return outlet valve. The pump housing includes a stepped opening and a piston opening. The piston is guided in the piston opening. The counterplate is pressed into the stepped opening and includes a valve seat. The non-return valve includes a valve element and a guide element. The guide element guides the valve element, is arranged radially outside the valve element and in the stepped opening, and includes a guide section, a retention section, and a support section. The guide section guides the valve element, the retention section is connected to the guide section via a radially extending connecting section, and the support section supports a valve spring. The sections are arranged axially at different points such that the guide section is between the counterplate and the support section.

13 Claims, 7 Drawing Sheets

(51) Int. Cl.
*F04B 53/16* (2006.01)
*F04B 1/00* (2006.01)

(52) U.S. Cl.
CPC ..... *F04B 53/106* (2013.01); *F04B 53/107* (2013.01); *F04B 53/1007* (2013.01); *F04B 53/1022* (2013.01); *F04B 53/1025* (2013.01); *F04B 53/1027* (2013.01); *F04B 53/1035* (2013.01); *F04B 53/1045* (2013.01); *F04B 53/1047* (2013.01); *F04B 53/1085* (2013.01); *F04B 53/1087* (2013.01); *F04B 53/16* (2013.01)

(58) Field of Classification Search
CPC .... F04B 53/10; F04B 53/1045; F04B 53/106; F04B 53/1047; F04B 53/1035; F04B 53/107; F04B 53/1025; F04B 53/1022; F04B 53/101; F04B 53/1007; F04B 53/1027
See application file for complete search history.

(56) References Cited

U.S. PATENT DOCUMENTS

| | | | | |
|---|---|---|---|---|
| 2,091,987 | A | 9/1937 | Honn | |
| 2,348,567 | A | 5/1944 | Parker | |
| 2,912,001 | A | 11/1959 | Green | |
| 3,191,617 | A | 6/1965 | Maddox | |
| 3,664,371 | A | 5/1972 | Schneider | |
| 3,916,496 | A | 11/1975 | Freiheit | |
| 4,265,271 | A | 5/1981 | Rosaen et al. | |
| 4,365,648 | A | 12/1982 | Grothe | |
| 4,368,756 | A | 1/1983 | Carlson | |
| 4,657,043 | A | 4/1987 | Ampferer et al. | |
| 4,706,705 | A | 11/1987 | Lee, II | |
| 4,856,555 | A | 8/1989 | Gausman et al. | |
| 4,964,423 | A | 10/1990 | Gausman et al. | |
| 5,065,790 | A | 11/1991 | Komas | |
| 5,758,682 | A | 6/1998 | Cain | |
| 6,206,032 | B1 | 3/2001 | Hill | |
| 6,439,263 | B2 | 8/2002 | Schwegler et al. | |
| 6,581,632 | B2 | 6/2003 | Walpole et al. | |
| 6,622,751 | B1 * | 9/2003 | Beck | B60T 8/4031 137/315.33 |
| 6,637,410 | B2 | 10/2003 | Onishi et al. | |
| 6,830,064 | B2 | 12/2004 | Ji | |
| 6,866,489 | B2 * | 3/2005 | Hinz | B60T 8/4031 137/454.4 |
| 7,581,560 | B2 | 9/2009 | Koch et al. | |
| 8,220,483 | B2 | 7/2012 | Gellweiler | |
| 8,240,634 | B2 * | 8/2012 | Jarchau | F04B 1/0452 251/29 |
| 8,347,458 | B2 | 1/2013 | Tseng et al. | |
| 8,684,029 | B2 | 4/2014 | Lee | |
| 2001/0022193 | A1 | 9/2001 | Schwegler et al. | |
| 2003/0056768 | A1 | 3/2003 | Onishi et al. | |
| 2004/0129517 | A1 | 7/2004 | Murata | |
| 2004/0163715 | A1 | 8/2004 | Hohmann | |
| 2004/0238043 | A1 | 12/2004 | Arnold et al. | |
| 2005/0175490 | A1 | 8/2005 | Seto et al. | |
| 2006/0021661 | A1 | 2/2006 | Koch et al. | |
| 2008/0029165 | A1 | 2/2008 | Beck | |
| 2009/0324437 | A1 | 12/2009 | Kuny | |
| 2010/0096027 | A1 | 4/2010 | Seto et al. | |
| 2011/0076171 | A1 | 3/2011 | Park et al. | |
| 2011/0091344 | A1 | 4/2011 | Christopherson, Jr. et al. | |
| 2011/0209687 | A1 | 9/2011 | Schroeder et al. | |
| 2012/0327840 | A1 | 12/2012 | Chen et al. | |

FOREIGN PATENT DOCUMENTS

| | | | |
|---|---|---|---|
| CN | 102410199 | A | 4/2012 |
| CN | 102422020 | A | 4/2012 |
| JP | 59-94664 | U | 6/1984 |
| JP | 63-89470 | U | 6/1988 |
| JP | 2-168082 | A | 6/1990 |
| JP | 2-132847 | U | 11/1990 |
| JP | 3-95091 | U | 9/1991 |
| JP | 8-312817 | A | 11/1996 |
| JP | 9-4741 | A | 1/1997 |
| JP | 2000-65227 | A | 3/2000 |
| JP | 2001-227662 | A | 8/2001 |
| JP | 2002-502940 | A | 1/2002 |
| JP | 2003-97387 | A | 4/2003 |
| JP | 2003-184549 | A | 7/2003 |
| JP | 2004-218547 | A | 8/2004 |
| JP | 2005-3034 | A | 1/2005 |
| JP | 2006-90200 | A | 4/2006 |
| JP | 2009-257197 | A | 11/2009 |
| JP | 4357296 | B2 | 11/2009 |
| JP | 2010-270762 | A | 12/2010 |
| JP | 2011-80391 | A | 4/2011 |
| JP | 2011-80571 | A | 4/2011 |
| JP | 4747843 | B2 | 8/2011 |
| KR | 20-0309144 | Y1 | 3/2003 |
| KR | 1020040037966 | A | 8/2004 |
| KR | 20-0380863 | Y1 | 4/2005 |
| KR | 100764694 | B1 | 1/2007 |
| KR | 10-2006-0048361 | B1 | 6/2007 |
| WO | 03/058100 | A1 | 7/2003 |

* cited by examiner

PISTON FUEL PUMP

This application is a continuation application of copending U.S. patent application Ser. No. 14/410,078, which was filed on Dec. 20, 2014 and is a 35 U.S.C. § 371 National Stage Application of PCT/EP2013/062578, filed on Jun. 18, 2013, which claims the benefit of priority to (i) patent application no. DE 10 2012 211 107.7, filed on Jun. 28, 2012 in Germany and (ii) patent application no. DE 10 2012 222 826.8, filed on Dec. 11, 2012 in Germany. The disclosures of each of the above-identified patent applications are incorporated herein by reference in their entirety.

TECHNICAL FIELD

The disclosure relates to a piston-type fuel pump.

BACKGROUND

Fuel systems of internal combustion engines in which the fuel is delivered from a fuel tank into a fuel rail at high pressure by means of a mechanically driven piston-type fuel pump are known from the market. For this purpose, the piston-type fuel pump has at least one inlet valve and one outlet valve. The outlet valve is in the form of a spring-loaded non-return valve, normally with a ball-shaped valve element.

SUMMARY

The problem addressed by the present disclosure is solved by means of a piston-type fuel pump. Advantageous refinements of the disclosure are specified in the claims. Further features of importance for the disclosure furthermore emerge from the following description and from the drawing.

The piston-type fuel pump according to the disclosure has the advantage that the production thereof can be simplified, and production costs thereby reduced, because the guide element is held securely in the pump housing without additional joining measures. By means of the guide element, reliability during the operation of the piston-type fuel pump is furthermore increased, because jamming is prevented and sealed closure is ensured. The guidance of the valve element by the guide element also reduces wear. The guidance of the valve element also ensures a temporally short closing process, which increases the efficiency of the piston-type fuel pump.

A first refinement is characterized in that the guide element has a guide section for guiding the valve element and has a retention section for retention in the opening of the pump housing, wherein the guide section and the retention section are arranged axially at different points of the guide element. The "guidance" function is thus spatially separate from the "retention" function. In this way, the quality of the "guidance" function is maintained even if radial deformation occurs in the "retention" region owing to said region being radially pressed in.

In a refinement of this, it is proposed that the guide element is pressed into a holding ring which in turn is pressed into the pump housing, wherein the holding ring preferably has fuel passage openings. The latter may be in the form of axially running ducts or in the form of intermediate spaces between the radially outwardly extending vane-like or lamellar fastening sections. The guide element can thus be of very simple construction, reducing the costs for the production thereof, because the fuel passage function is performed by the separate holding ring.

It is also proposed that the guide element has a stroke stop which limits the opening stroke of the valve element to a predefined value. This has the advantage that the closing impetus of the valve element onto the valve seat is reduced by virtue of the flight path of the valve element being reduced by the stroke stop. The occurring accelerations thus act only over a limited distance, which leads to a lower closing speed of the valve element. This reduces the damaging effects during the closing process, in particular the wear generated both on the valve element and also on the valve seat as a result of the closing impact. Furthermore, the reduced flight path results in a temporally shortened closing process, which increases the efficiency of the piston-type fuel pump. Furthermore, the lower closing speed leads to a lower impact speed of the valve element against the valve seat, which leads to a reduction in noise during the operation of the piston-type fuel pump.

A further advantageous refinement of the piston-type fuel pump according to the disclosure is distinguished by the fact that the guide element is arranged coaxially with respect to and radially outside the valve element and has a radially inwardly directed shoulder that forms the stroke stop. A guide element of said type is simple to produce, and the radially inwardly directed stroke stop may be formed for example by an annular shoulder with which the valve element comes into contact over the largest possible area, whereby the loads on the valve element are kept low. Furthermore, a guide element of said type does not pose an obstruction to the accommodation of the valve spring.

As an alternative to this, it is also possible for the guide element to have, at least in sections, a smaller internal diameter than the valve element and to be arranged coaxially with respect to the valve element, and for that end of the guide section which points toward the valve element to form the stroke stop, or for it to have a radially outwardly directed shoulder that forms the stroke stop. This, too, is simple to manufacture and assemble, and furthermore has the advantage of the relatively small radial dimensions.

Here, it is particularly advantageous for a valve spring to also be guided by the guide element. In this way, the guide element performs not just one but two or possibly even three tasks. Owing to the integration of the different functions, components and thus manufacturing and assembly costs are saved.

This integration of different functions into said guide element can be further enhanced if it has a support section on which that end of the valve spring which is situated opposite the valve element is supported.

Is also proposed that the valve spring be a spiral-type or stellate flat diaphragm spring that is fastened to the guide element or directly to the pump housing. In this way, the axial structural height of the outlet valve can be reduced.

The guide element may be a sintered or MIM part. Such a part exhibits considerable mechanical robustness and thus permanently only very low wear.

Finally, it is also proposed that the valve element be of pot-shaped form. The encircling wall of a valve element of said type is particularly suitable as a guide wall in interaction with the above-mentioned guide element. Nevertheless, a valve element of said type has a relatively low mass and thus good dynamics, which in turn is to the benefit of the efficiency of the piston-type fuel pump according to the disclosure.

BRIEF DESCRIPTION OF THE DRAWINGS

Examples of the present disclosure will be explained in more detail below with reference to the appended drawings, in which.

DETAILED DESCRIPTION

Figure 1:
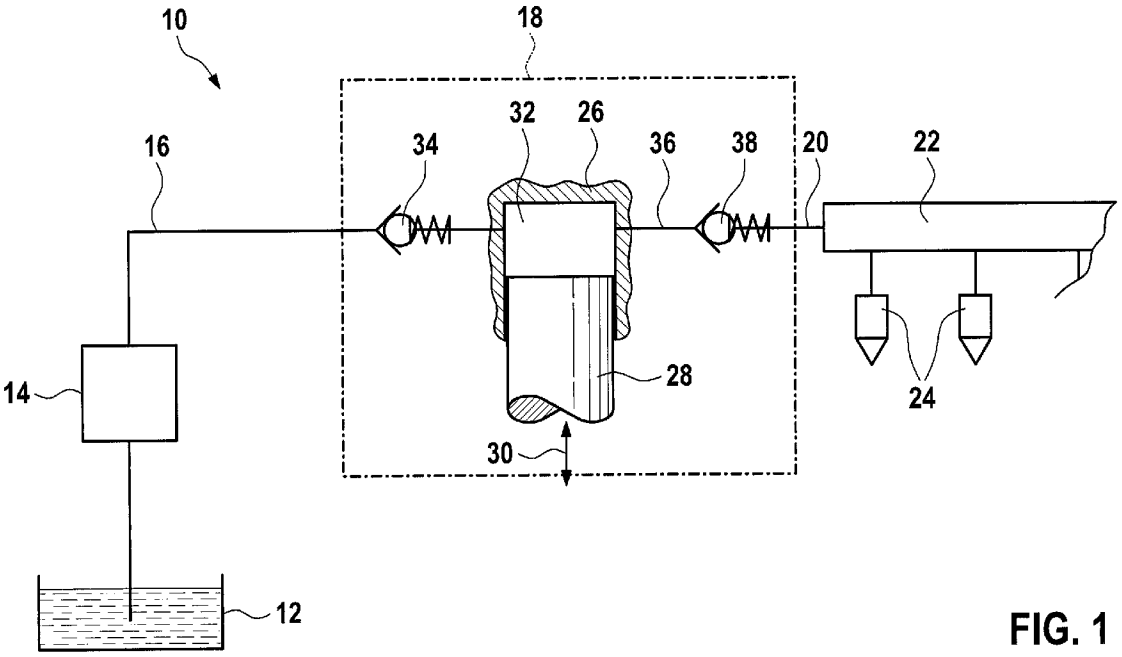
FIG. 1 shows a schematic illustration of a fuel system of an internal combustion engine having a piston-type fuel pump, which in turn has an outlet valve.

A fuel system of an internal combustion engine is denoted as a whole in FIG. 1 by the reference sign 10. Said fuel system comprises a fuel tank 12 from which an electric pre-delivery pump 14 delivers the fuel into a low-pressure line 16. The latter leads to a high-pressure pump, indicated by a dash-dotted line, in the form of a piston-type fuel pump 18. A high-pressure line 20 leads from the latter to a fuel rail 22. Connected to said fuel rail there are multiple injectors 24 which inject the fuel directly into respectively associated combustion chambers (not illustrated).

The piston-type fuel pump 18 comprises a pump housing 26 (only partially indicated) in which a pump piston 28 is guided. The latter can be set in a reciprocating motion by a drive (not illustrated), as indicated by a double arrow 30. The pump piston 28 and the pump housing 26 delimit a delivery chamber 32. The latter is connected via an inlet valve 34 to the low-pressure line 16. Furthermore, the delivery chamber 32 is connected via a high-pressure duct 36 to an outlet valve 38, which in turn is connected at the outlet side to the high-pressure line 20.

Both the inlet valve 34 and the outlet valve 38 are in the form of spring-loaded non-return valves. Here, an embodiment of the inlet valve as a flow-rate control valve is not illustrated but is possible. In the case of such a valve, the inlet valve 34 can be positively opened during a delivery stroke of the pump piston 28, such that the fuel is delivered not into the fuel rail 22 but back into the low-pressure line 16. The fuel flow rate delivered by the piston-type fuel pump 18 into the fuel rail 22 can be adjusted in this way.

Figure 2:
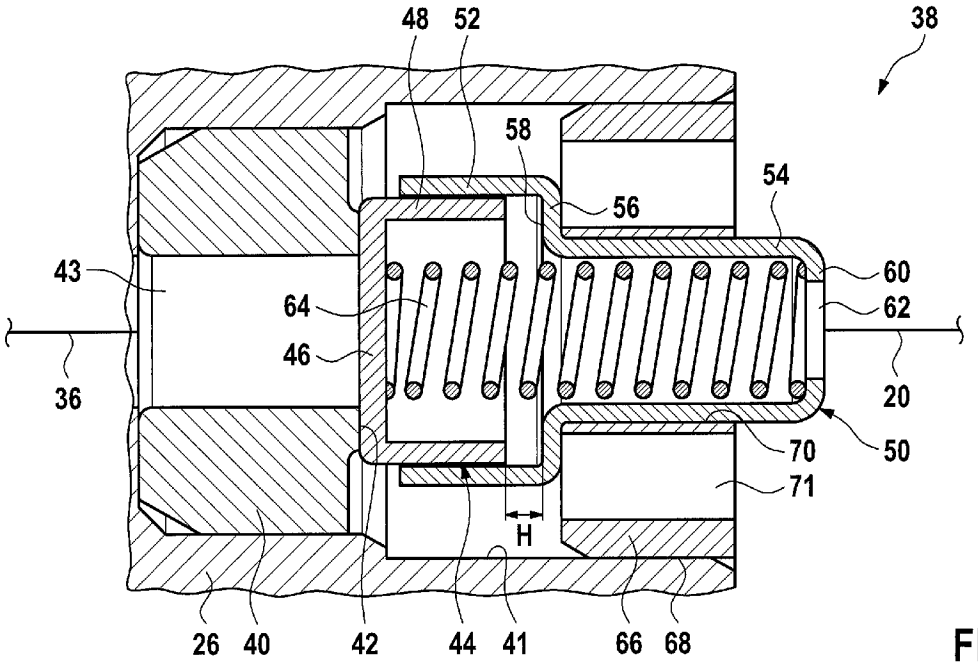
FIG. 2 shows a longitudinal section through a first embodiment of the outlet valve of FIG. 1.

The design of the outlet valve 38 is of particular significance in the present case. This will therefore now be discussed in more detail with reference to FIG. 2:

FIG. 2 shows a first embodiment of the outlet valve 38 in section. At the far left-hand side in FIG. 2, an annular counterplate 40 is pressed into a stepped opening 41 provided in the pump housing 26, wherein the counterplate 40 has, on its right-hand face side in FIG. 2, an axially extending, collar-like section which forms a valve seat 42. The latter interacts with a pot-shaped valve element 44. The counterplate 40 is of annular form, with an internal duct 43. The pot-shaped valve element 44 comprises a base 46 and an encircling guide wall 48. The opening 41 is part of the high-pressure duct 36.

The outlet valve 38 also comprises a cylindrical guide element in the form of a sleeve 50, which in the present case is of stepped form. Said sleeve has a first section 52 ("guide section") on the left in FIG. 2 and a second section 54 ("retention section") on the right in FIG. 2. The first section 52 has a larger diameter than the second section 54. The two sections 52 and 54 are connected to one another by a radially extending connecting section 56. In the present case, the guide element 50, as a sheet-metal part, is produced by a deep-drawing process. The internal diameter of the first section 52 is very slightly larger than the external diameter of the guide wall 48 of the valve element 44. In this way, the valve element 44 is movable in sliding fashion in the axial direction in the first section 52 of the guide element 50 but is guided so as to be static in the radial direction. Here, in a direction away from the valve seat 42, that face surface of the connecting section 56 which faces toward the valve element 44 forms a stroke stop 58 for the valve element 44 or for the projecting edge of the guide wall 48 thereof.

At its right-hand end in FIG. 2, the guide element 50 has a radially inwardly directed web 60, the inner edge of which delimits an opening 62. Between the web 60 of the guide element 50 and the valve element 44 there is braced a helical valve spring 64. The inwardly directed web 60 thus forms a support section for that end of the valve spring 64 which is situated opposite the valve element 44. The outer diameter of the valve spring 64 and the inner diameter of the second section 54 of the guide element 50 are coordinated with one another such that the valve spring 64 is guided radially in the second section 54 of the guide element 50.

The outlet valve 38 furthermore comprises a holding ring 66 which is pressed by way of its outer wall 68 into the opening 41 in the pump housing 26. The second section 54 of the guide element 50 is in turn pressed into the inner opening 70 of the holding ring 66. Here, the connecting section 56 bears by way of its side pointing to the right in FIG. 2 against that side of the holding ring 66 which points to the left in FIG. 2. The guide element 50 can thus be compressed in the holding ring 66 with very low contact pressure, possibly even simply loosely inserted into the holding ring 66, without this influencing the functionality of the outlet valve 38. Multiple duct-like fuel passage openings 71 are provided in the holding ring 66.

During operation of the piston-type fuel pump 18, the valve element 44 lifts off from the valve seat 42 when the pressure in the delivery chamber 32 reaches a corresponding opening value during a delivery stroke of the pump piston 28. The stroke of the valve element 44 is however limited by the stroke stop 58 to a predefined value H which corresponds to the spacing between the stroke stop 58 and the projecting edge of the guide wall 48 of the valve element 44 when the outlet valve 38 is closed. When the outlet valve 38 is open, the fuel flows through the inlet duct 43 into the counterplate 40, through the gap between the valve seat 42 and base 46 of the valve element 44, through the annular chamber between the first section 52 of the guide element 50 and the inner wall of the opening 41 in the pump housing 26, through the fuel passage openings 71, and finally into the high-pressure line 20.

Figure 3:
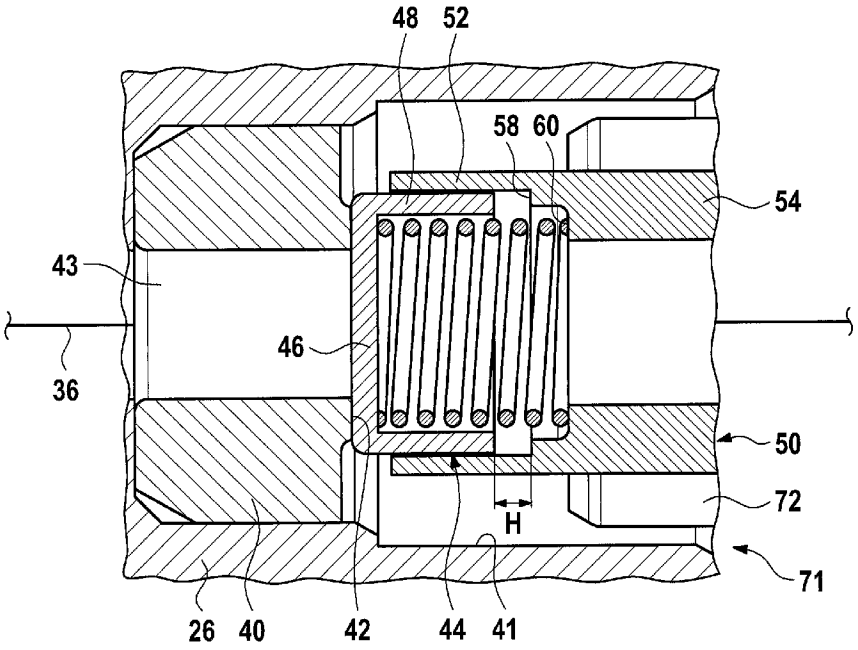
FIG. 3 shows a longitudinal section through a second embodiment of the outlet valve of FIG. 1.

FIG. 3 shows an alternative embodiment of an outlet valve 38. Here, and below, elements and regions which have functions equivalent to elements and regions of the outlet valve of FIG. 2 are denoted by the same reference signs. Such elements and regions will not be explained again below.

The outlet valve 38 of FIG. 3 differs from that of FIG. 2 primarily by the design of the guide element 50 and the retention thereof: in FIG. 3, the guide element 50 is produced as a sintered or MIM part. Radially at the outside, the guide element 50 has a constant diameter. In the interior, it has a first annular shoulder, which forms the stroke stop 58, and a second shoulder, which forms the support section 60 for the valve spring 64. The guide element 50 is compressed in the pump housing 26 by radially outwardly extending vane-like or lamellar sections 72, between which there are provided intermediate spaces which form the fuel passage openings 71.

In the embodiments of FIGS. 4 to 11, the valve element 44 is not of pot-shaped form but, conversely, is of mushroom-shaped form with a valve plate 46 and a "stem" 48. Furthermore, the cylindrical guide element 50 has a smaller internal diameter than the valve element 44, but like before, is arranged coaxially with respect to the valve element 44. That end of the guide element 50 which points toward the valve element 44 forms the stroke stop 58. The guide element 50 is held in the pump housing 26 by means of multiple radially projecting vanes 72, between which there are provided passage openings 71 for the fuel. Finally, the valve spring 64 is a flat diaphragm spring which is fastened to the top side of the guide element 50.

Figure 4:
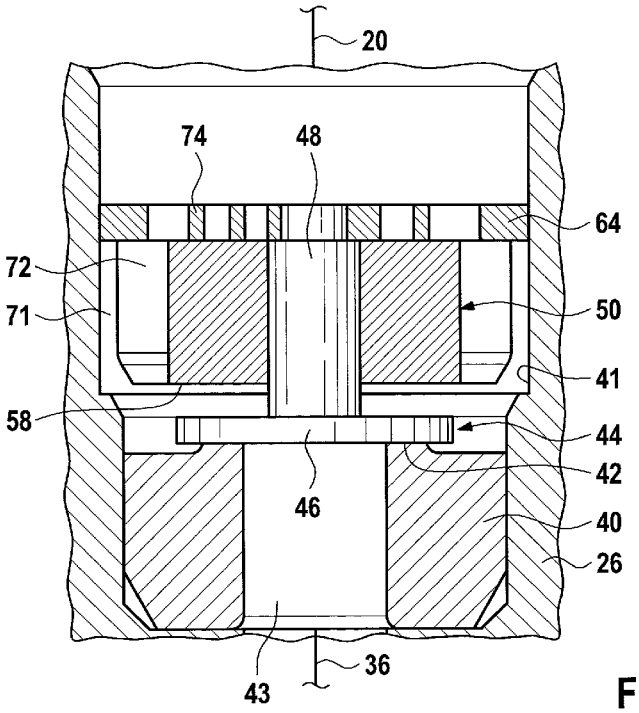
FIG. 4 shows a longitudinal section through a third embodiment of the outlet valve of FIG. 1.
Figure 5:
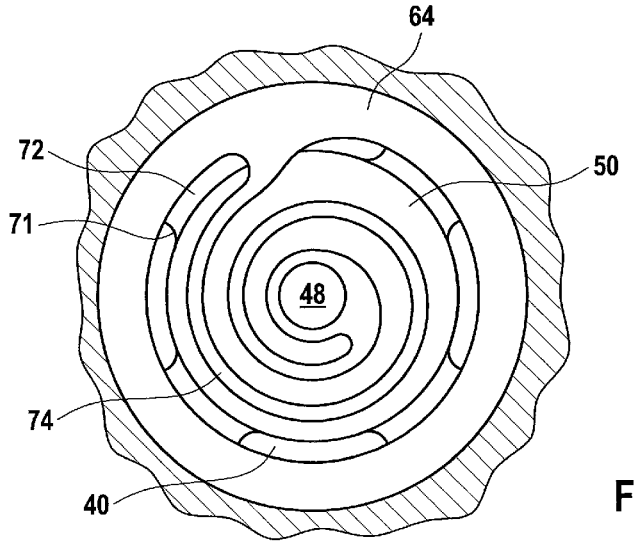
FIG. 5 shows a plan view of the outlet valve of FIG. 4.
Figure 6:
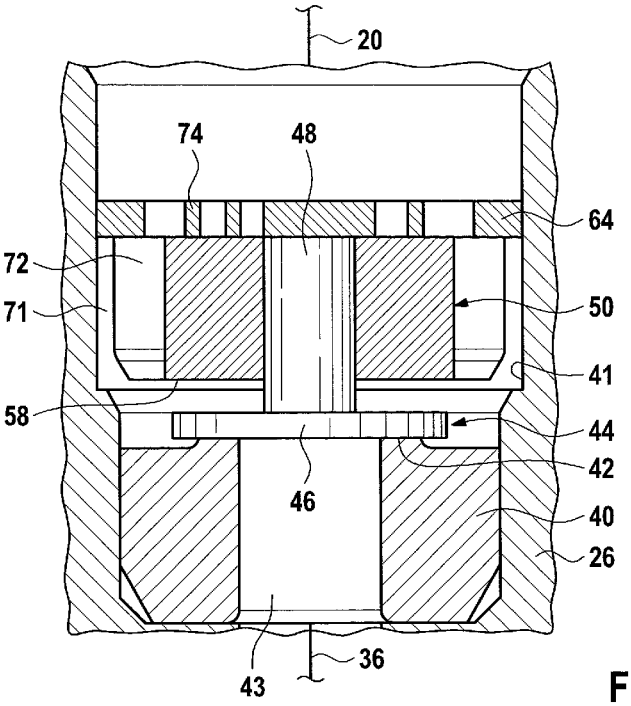
FIG. 6 shows a longitudinal section through a fourth embodiment of the outlet valve of FIG. 1.
Figure 7:
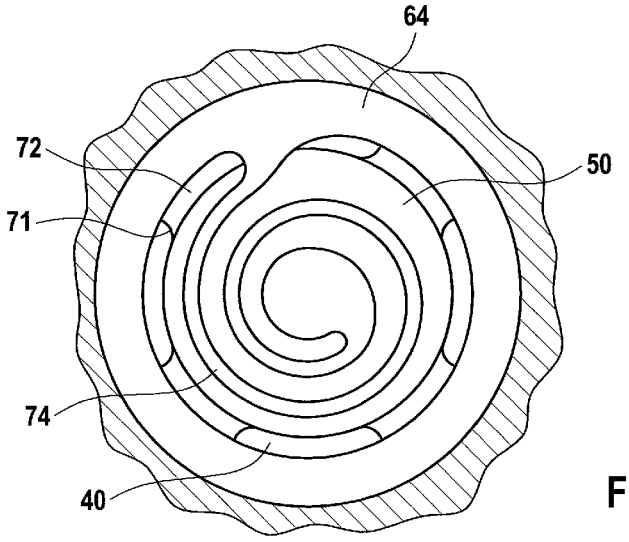
FIG. 7 shows a plan view of the outlet valve of FIG. 6.
Figure 8:
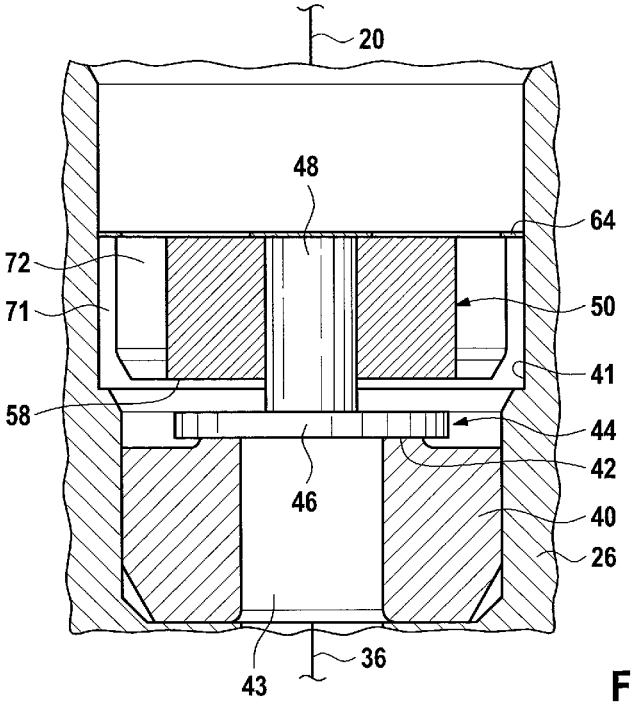
FIG. 8 shows a longitudinal section through a fifth embodiment of the outlet valve of FIG. 1.
Figure 9:
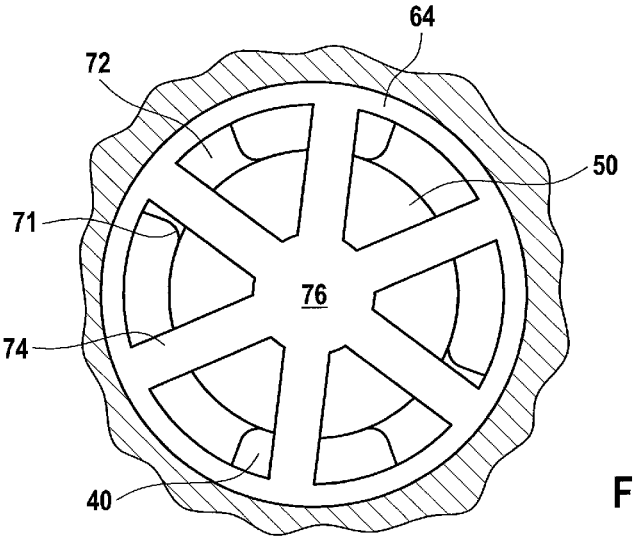
FIG. 9 shows a plan view of the outlet valve of FIG. 8.
Figure 10:
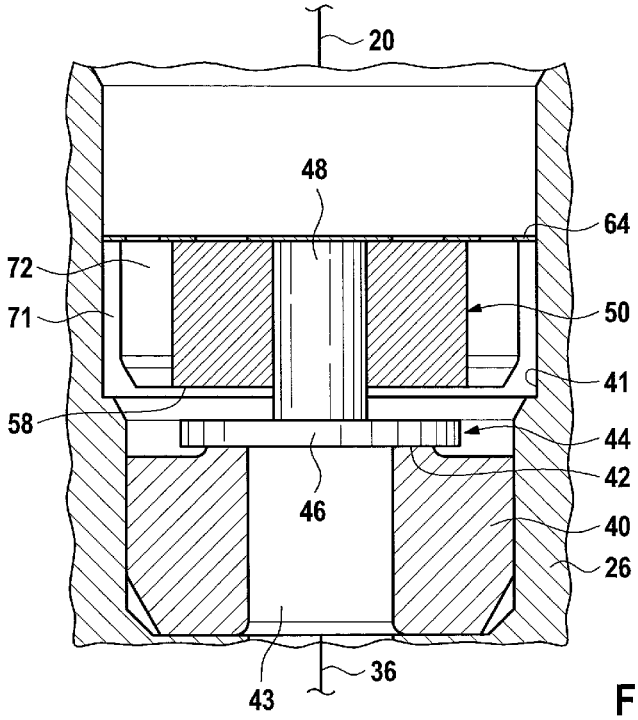
FIG. 10 shows a longitudinal section through a sixth embodiment of the outlet valve of FIG. 1.
Figure 11:
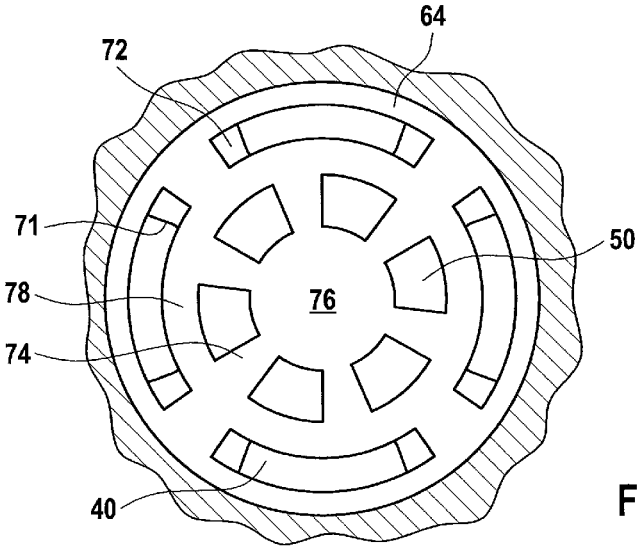
FIG. 11 shows a plan view of the outlet valve of FIG. 10.

In the embodiments of FIGS. 4 to 7, the flat diaphragm spring 64 is formed with a spring arm 74 which is coiled inwardly in spiral form and against the end of which the stem 48 of the valve element 44 bears (FIGS. 6 and 7), or into the end of which the reduced-diameter end of the stem 48 of the valve element 44 is fitted (FIGS. 4 and 5).

In the embodiments of FIGS. 8 to 11, the flat diaphragm spring 64 is of rosette-like form with a multiplicity of spring arms 74 which run radially in stellate fashion and which are held in a center 76 against which the end of the stem 48 of the valve element 44 bears. The flat diaphragm spring 64 of FIGS. 10 and 11 furthermore has an intermediate ring 78.

What is claimed is:

1. A piston-type fuel pump for an internal combustion engine, comprising:

a pump housing including a stepped opening and piston opening separate from the stepped opening, the stepped opening having a first stepped portion defining a first inner diameter and a second stepped portion defining a second inner diameter, the first inner diameter greater than the second inner diameter;

a piston guided in the piston opening of the pump housing;

an annular counterplate pressed into the second stepped portion of the second stepped opening and including a valve seat; and a non-return outlet valve that includes:

a valve element; and a guide element configured to guide movement of the valve element, arranged in the stepped opening of the pump housing, and including:

a guide section configured to guide the valve element;

a retention section connected to the guide section via a radially extending connecting section; and a support section configured to support an end of a valve spring, wherein the guide section, the retention section, and the support section are arranged axially at different points of the guide element such that the guide section is located between the annular counterplate and the support section in an axial direction, and wherein the guide element is arranged coaxially with respect to and radially outside the valve element.

2. The piston-type fuel pump as claimed in claim 1, wherein the guide element is arranged radially outside the valve spring.

3. The piston-type fuel pump as claimed in claim 1, wherein the annular counterplate includes an annular form and an internal duct.

4. The piston-type fuel pump as claimed in claim 1, wherein the guide element includes a stepped form.

5. The piston-type fuel pump as claimed in claim 1, wherein the radially extending connecting section is arranged orthogonally to a valve movement axis.

6. The piston-type fuel pump as claimed in claim 1, wherein the guide element includes a sheet-metal material.

7. A piston-type fuel pump for an internal combustion engine, comprising:

a pump housing including a stepped opening;

a piston guided in the pump housing;

an annular counterplate pressed into the stepped opening and including a valve seat; and a non-return outlet valve including:

a valve element; and a guide element configured to guide movement of the valve element, arranged in the opening of the pump housing, and including:

a guide section configured to guide the valve element;

a retention section connected to the guide section via a radially extending connecting section; and a support section configured to support an end of a valve spring, wherein the guide section, the retention section, and the support section are arranged axially at different points of the guide element such that the guide section is located between the annular counterplate and the support section in an axial direction.

8. The piston-type fuel pump as claimed in claim 7, wherein the guide element is arranged coaxially with respect to and radially outside the valve element.

9. The piston-type fuel pump as claimed in claim 7, further comprising a valve spring, wherein the guide element is arranged radially outside the valve spring.

10. The piston-type fuel pump as claimed in claim 7, wherein the counterplate includes an annular form and an internal duct.

11. The piston-type fuel pump as claimed in claim 7, wherein the guide element includes a stepped form.

12. The piston-type fuel pump as claimed in claim 7, wherein the radially extending connecting section is arranged orthogonally to a valve movement axis.

13. The piston-type fuel pump as claimed in claim 7, wherein the guide element includes a sheet-metal material.

* * * * *